US008734636B2

(12) United States Patent
Tanaka

(10) Patent No.: US 8,734,636 B2
(45) Date of Patent: May 27, 2014

(54) METHOD OF MANUFACTURING DIESEL FUEL

(75) Inventor: Yuichi Tanaka, Yokohama (JP)

(73) Assignees: Japan Oil, Gas and Metals National Corporation, Kanagawa (JP); Inpex Corporation, Tokyo (JP); Nippon Oil Corporation, Tokyo (JP); Japan Petroleum Exploration Co., Ltd., Tokyo (JP); Cosmo Oil Co., Ltd., Tokyo (JP); Nippon Steel Engineering Co., Ltd., Tokyo (JP)

( * ) Notice: Subject to any disclaimer, the term of this patent is extended or adjusted under 35 U.S.C. 154(b) by 785 days.

(21) Appl. No.: 12/733,860

(22) PCT Filed: Sep. 25, 2008

(86) PCT No.: PCT/JP2008/067271
§ 371 (c)(1),
(2), (4) Date: Jun. 2, 2010

(87) PCT Pub. No.: WO2009/041478
PCT Pub. Date: Apr. 2, 2009

(65) Prior Publication Data

US 2010/0300933 A1 Dec. 2, 2010

(30) Foreign Application Priority Data

Sep. 28, 2007 (JP) ..... 2007-256545

(51) Int. Cl.
*C10G 63/02* (2006.01)

(52) U.S. Cl.
USPC ..... 208/78; 208/49; 208/79

(58) Field of Classification Search
USPC ..... 208/49, 78, 79, 92, 950
See application file for complete search history.

(56) References Cited

U.S. PATENT DOCUMENTS 6,589,415 B2 7/2003 Smith et al.
6,635,681 B2 * 10/2003 Moore et al. ..... 518/700

(Continued)

FOREIGN PATENT DOCUMENTS

CN 1295117 5/2001
FR 2887556 12/2006

(Continued)

OTHER PUBLICATIONS

Yoon, S.H. et al. (2008). Energy & Fuels, 22, 652-656.*

(Continued)

*Primary Examiner* — Brian McCaig
(74) *Attorney, Agent, or Firm* — Kenyon & Kenyon LLP

(57) ABSTRACT

Provided is a method of manufacturing diesel fuel, including: fractionating in a first fractionator a synthetic oil obtained by Fisher-Tropsch synthesis into at least two fractions of a middle fraction, and a wax fraction containing a wax component heavier than the middle fraction; hydroisomerizing the middle fraction by bringing the middle fraction into contact with a hydroisomerizing catalyst to produce a hydroisomerized middle fraction; hydrocracking the wax fraction by bringing the wax fraction into contact with a hydrocracking catalyst to produce a wax decomposition compound; fractionating in a second fractionator a mixture of the hydroisomerized middle fraction and the hydrocracked wax fraction into at least two fractions including a kerosene fraction and a gas oil fraction; and mixing the at least two fractions at a predetermined blend ratio to produce a diesel fuel having a kinematic viscosity at 30° C. of 2.5 $mm^2/s$ or more and a pour point of −7.5° C. or less.

5 Claims, 1 Drawing Sheet

(56) References Cited

U.S. PATENT DOCUMENTS

| | | | | |
|---|---|---|---|---|
| 6,656,342 | B2 | 12/2003 | Smith et al. | |
| 2007/0100177 | A1* | 5/2007 | Clark et al. | 585/14 |
| 2008/0244966 | A1* | 10/2008 | Ansell et al. | 44/436 |

FOREIGN PATENT DOCUMENTS

| | | |
|---|---|---|
| JP | 2004-526034 | 8/2004 |
| JP | 2004-526035 | 8/2004 |
| JP | 2004-323626 | 11/2004 |
| JP | 2007-238870 | 9/2007 |
| JP | 2007-269899 | 10/2007 |
| WO | 2005/091815 | 10/2005 |
| WO | 2006/067174 | 6/2006 |
| WO | 2006/069990 | 7/2006 |
| WO | WO 2007/113967 | 10/2007 |

OTHER PUBLICATIONS

Speight, J.G. (1999). The Chemistry and Technology of Petroleum, Marcel-Dekker, 918 pgs.*

Japanese Notice of Allowance, dated Aug. 14, 2012, issued in corresponding Japanese application No. 2009-534348. (with English Translation).

Chinese Office Action, dated Aug. 23, 2012, issued in corresponding Chinese application No. 200880108564.X. (with English Translation of Search Report).

European Search Report dated Jul. 4, 2013 issued in corresponding EP Application No. 08 83 4006.

* cited by examiner

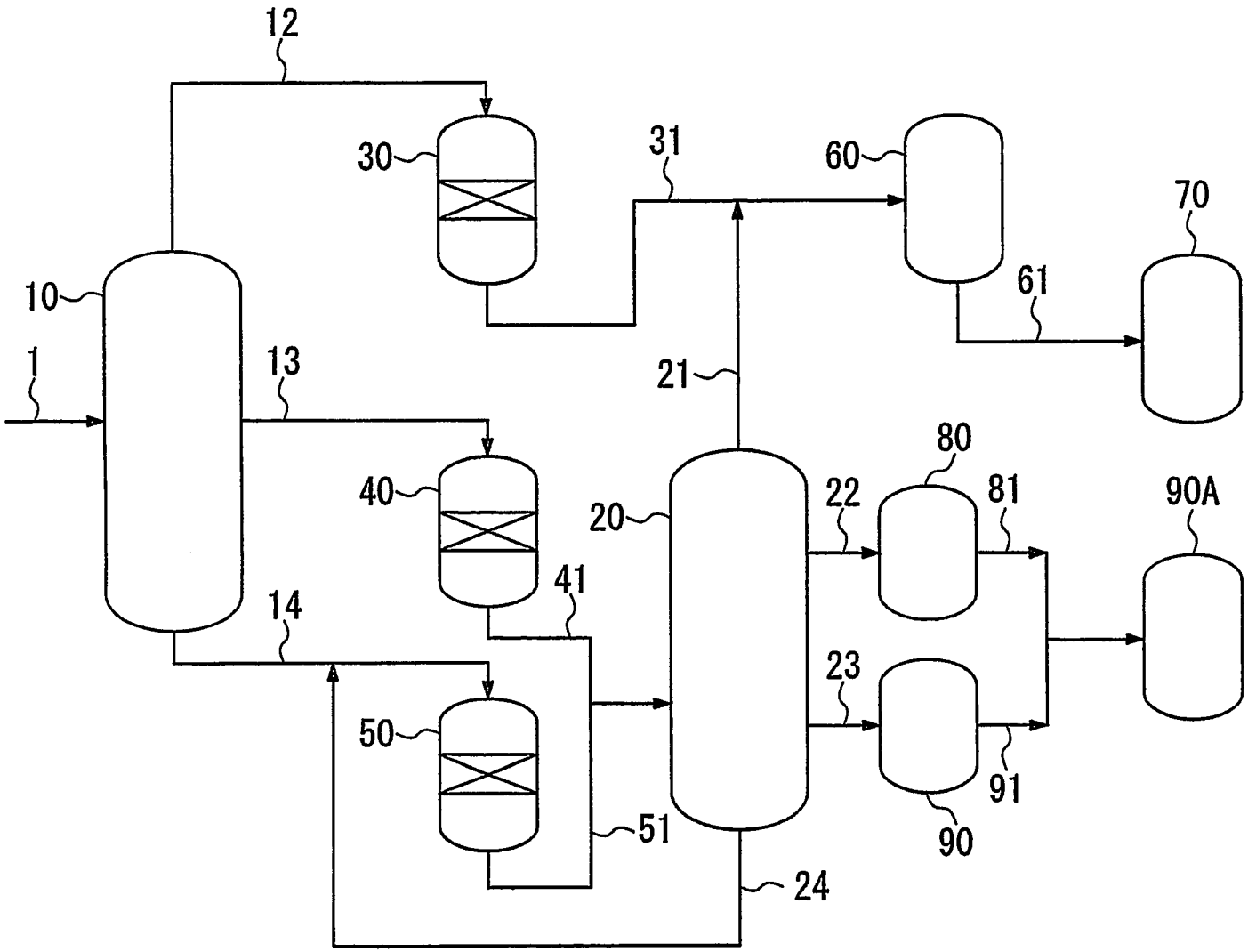
70
90A
61
81
91
80
90
60
22
23
24
31
21
20
51
41
30
40
50
12
13
14
10
1

METHOD OF MANUFACTURING DIESEL FUEL

This application is a national stage application of International Application No. PCT/JP2008/067271, filed 25 Sep. 2008, which claims priority to Japanese Application No. 2007-256545, filed 28 Sep. 2007 which is incorporated by reference in its entirety.

TECHNICAL FIELD

The present invention relates to a method of manufacturing diesel fuel from synthetic oil obtained according to a Fisher-Tropsch synthesis method.

BACKGROUND ART

In recent years, from the standpoint of reduction of environmental burdens, there has been a need for a clean liquid fuel which has a low content of sulfur and aromatic hydrocarbons and is compatible with the environment. Thus, in the petroleum industry, a Fisher-Tropsch synthesis method (hereinafter abbreviated as "FT synthesis method) using carbon monoxide and hydrogen as raw materials has been investigated as a method of manufacturing a clean fuel. The FT synthesis method has high expectations since it can manufacture a liquid fuel base stock which has an abundance of paraffin and which does not contain sulfur, for example, a diesel fuel base stock. For example, Patent Document 1 discloses a fuel oil compatible with the environment.

Patent Document 1: Japanese Unexamined Patent Application, Publication No. 2004-323626

A synthetic oil obtained by the FT synthesis method (hereinafter may be referred to as "FT synthetic oil") has a broad carbon number distribution. From the FT synthetic oil, it is possible to obtain, for example, an FT naphtha fraction containing a number of hydrocarbons having a boiling point of less than 150° C., an FT middle fraction containing a number of hydrocarbons having a boiling point of 150° C. to 360° C., and an FT wax fraction heavier than the FT middle fraction.

There is a concern that the FT middle fraction has insufficient low temperature-performance if the fraction is not processed because the FT middle fraction contains a great quantity of n-paraffins.

Furthermore, a substantial quantity of the FT wax fraction is simultaneously produced. Therefore, if such FT wax fraction can be converted to lighter products by way of hydrocracking the FT fraction, this will result in increased production of a diesel fuel.

Accordingly, the FT synthetic oil is fractionated into the FT middle fraction and the FT wax fraction, and the FT middle fraction is hydroisomerized to increase the iso-paraffin content in order to improve its low temperature performance.

On the other hand, the FT wax fraction is hydrocracked to convert the FT wax fraction to lighter products, thereby increasing the amount of the middle fraction. Accordingly, a sufficient quantity of a diesel fuel having sufficient performance can be obtained as the middle fraction from FT synthetic oil.

DISCLOSURE OF THE INVENTION

Problem that the Invention is to Solve

Since decomposition products are formed into lighter products in hydrocracking, the products have sufficient low temperature performance to some extent. In addition, hydroisomerized products also have sufficient low temperature performance. Accordingly, if a fraction, which corresponds to the middle fraction, obtained from the hydrocracked products is mixed with the isomerized products, and the mixture is again fractionated to manufacture a diesel fuel, the yield of diesel fuel can be increased.

In addition, the diesel fuel requires a predetermined kinematic viscosity or higher in order to prevent generation of a broken oil film. In addition, it is better for the diesel fuel to have a lower pour point (PP) for use in cold regions.

However, because requirement of a predetermined high kinematic viscosity or higher, and requirement of a lower PP are contrary to each other, it is very difficult to conform both requirements to their standard ranges (for example, standard ranges corresponding to JIS No. 2 gas oil). In particular, as described above, in those instances where a plurality of fractions are mixed and fractionated in a second fractionator to obtain a single middle fraction as a diesel fuel oil fraction, the broader the boiling range of each fraction is, the more difficult it is to predict physical properties of the obtained single middle fraction, and also, the more difficult it is to control operation of a fractionator so as not to deviate from a standard. Accordingly, it is required to repeat trial-and-error testing. Needless to say, such repetition of trial and error is uneconomical.

Means for Solving the Problem

In order to solve the above-described problems, in the present invention, not a single middle fraction but a plurality of middle fractions (for example, a kerosene fraction and a gas oil fraction) is first produced in a second fractionator by way of fractionation to obtained fractions having a narrower boiling range whose physical properties can be easily predicted. Then, both fractions are mixed at a predetermined ratio such that the kinematic viscosity and the pour point (PP) simultaneously fulfill their respective standard ranges (for example, standard ranges corresponding to JIS No. 2 gas oil). Such acquisition of the plurality of middle fractions (not a single middle fraction) in the second fractionator requires corresponding equipment such as pipes, storage tanks or the like, and therefore, such equipment may be costly. However, this is rather economical because a diesel fuel whose kinematic viscosity and PP simultaneously fulfill the respective standard ranges will be certainly obtained without repeating operation control by trial and error.

Specifically, an aspect of the present invention relates to the following.

[1] A method of manufacturing diesel fuel, including: fractionating in a first fractionator a synthetic oil obtained by Fisher-Tropsch synthesis into at least two fractions of a middle fraction, and a wax fraction containing a wax component heavier than the middle fraction; hydroisomerizing the middle fraction by bringing the middle fraction into contact with a hydroisomerizing catalyst to produce a hydroisomerized middle fraction; hydrocracking the wax fraction by bringing the wax fraction into contact with a hydrocracking catalyst to produce a wax decomposition compound; fractionating in a second fractionator a mixture of the hydroisomerized middle fraction and the hydrocracked wax fraction into at least two fractions including a kerosene fraction and a gas oil fraction; and mixing the at least two fractions at a predetermined blend ratio to produce a diesel fuel having a kinematic viscosity at 30° C. of 2.5 $mm^2/s$ or more and a pour point of −7.5° C. or less.

[2] The method of manufacturing diesel fuel according to [1], wherein the kerosene fraction contains 80% by volume or more of a component having a boiling point of 150° C. to 250° C., and the gas oil fraction contains 80% by volume or more of a component having a boiling point of 250° C. to 360° C.

[3] The method of manufacturing diesel fuel according to [1] or [2], wherein, in mixing the kerosene fraction and the gas oil fraction to produce the diesel fuel, the appropriate blend ratio of the kerosene fraction and the gas oil fraction is obtained by the following Procedures (1) to (3) where the kinematic viscosity at 30° C. and the pour point of the diesel fuel fall within predetermined ranges:

Procedure (1) wherein the composition of the kerosene fraction and the composition of the gas oil fraction are analyzed based on an all-component analysis by gas chromatography in advance, and then, assuming that the kerosene fraction and the gas oil fraction are mixed at a specific ratio, the composition of the produced diesel fuel is predicted with respect to $x^{[M.W.]}$ and $[nC19^+]$;

Procedure (2) wherein, based on the composition of the produced diesel fuel predicted in Procedure (1), the kinematic viscosity [Vis.] at 30° C. of the diesel fuel is calculated by Equation 1 and the pour point of the diesel fuel is calculated by Equation 2; and Procedure (3) wherein, as the predetermined ranges for the kinematic viscosity at 30° C. and the pour point of the diesel fuel, if the kinematic viscosity at 30° C. of the diesel fuel calculated in Procedure (2) is 2.5 $mm^2/s$ or more and the pour point of the diesel fuel calculated in Procedure (2) is −7.5° C. or less, the specific ratio of the kerosene fraction and the gas oil fraction assumed in Procedure (1) is considered as the appropriate blend ratio of the kerosene fraction and the gas oil fraction to complete the procedures, and if the kinematic viscosity at 30° C. and the pour point of the diesel fuel calculated in Procedure (2) are not within the defined ranges, Procedures (1) to (3) are repeated to obtain the appropriate blend ratio of the kerosene fraction and the gas oil fraction where the kinematic viscosity at 30° C. and the pour point of the diesel fuel are within the defined ranges, where $$[\text{Vis.}]=0.1309\times e(0.0144\times x^{[M.W.]}) \quad \text{Equation 1,}$$

and $$[\text{PP}]=46.37\times\log([nC19^+]+1.149)-45 \quad \text{Equation 2}$$

wherein, [Vis.] represents the kinematic viscosity at 30° C.; [PP] represents the pour point; $x^{[M.W.]}$ represents the average molecular weight of the diesel fuel; and $[nC19^+]$ represents the content of normal paraffins having 19 or more carbon atoms in the diesel fuel by mass percentage.

[4] The method of manufacturing diesel fuel according to any one of [1] to [3], wherein, when bringing the middle fraction into contact with the hydroisomerizing catalyst, the reaction temperature is 180° C. to 400° C., the hydrogen partial pressure is 0.5 MPa to 12 MPa, and the liquid hourly space velocity is 0.1 $h^{-1}$ to 10.0 $h^{-1}$, and, when bringing the wax fraction into contact with the hydrocracking catalyst, the reaction temperature is 180° C. to 400° C., the hydrogen partial pressure is 0.5 MPa to 12 MPa, and the liquid hourly space velocity is 0.1 $h^{-1}$ to 10.0 $h^{-1}$.

Advantage of the Invention

According to the present invention, while fractionating in the second fractionator, a plurality of middle fractions, which have a narrower boiling range and whose PP and kinematic viscosity are easily predictable, are first obtained, and then, the fractions are mixed at a predetermined ratio. Therefore, both the kinematic viscosity and the PP easily fall within their respective standard range (standard ranges corresponding to HS No. 2 gas oil where the kinematic viscosity at 30° C. is 2.5 $mm^2/s$ or more, and the PP is −7.5° C. or below). The facilities required for the present invention may be costly. However, a diesel fuel whose kinematic viscosity and PP simultaneously fall within the respective standard ranges can be certainly obtained without repetition of operation control by trial and error. Therefore, in fact, the present invention is a cost-effective method.

As a result, it is possible to achieve increased production in manufacturing a diesel fuel from FT synthetic oil while excellent low temperature properties can be achieved.

BRIEF DESCRIPTION OF THE DRAWINGS

FIG. 1 is a schematic diagram showing one embodiment of a plant for manufacturing, a diesel fuel according to the invention. The manufacturing plant includes a first fractionator 10 wherein FT synthetic oil is fractionated; and a hydro-refining apparatus 30, a hydroisomerizing apparatus 40 and a hydrocracking apparatus 50 where a naphtha fraction, a middle oil fraction and a wax fraction fractionated in the first fractionator 10 are treated.

DESCRIPTION OF REFERENCE NUMERALS

10: A FIRST FRACTIONATOR WHEREIN FT SYNTHETIC OIL IS FRACTIONATED

20: A SECOND FRACTIONATOR WHEREIN THE MIXTURE OF PRODUCTS FROM THE HYDROISOMERIZING APPARATUS 40 AND THE HYDROCRACKING APPARATUS 50 IS FRACTIONATED

30: A HYDRO-REFINING APPARATUS FOR A NAPHTHA FRACTION FRACTIONATED IN THE FIRST FRACTIONATOR 10

40: A HYDROISOMERIZING APPARATUS FOR A FIRST MIDDLE FRACTION FRACTIONATED IN THE FIRST FRACTIONATOR 10

50: A HYDROCRACKING APPARATUS FOR A WAX FRACTION FRACTIONATED IN THE FIRST FRACTIONATOR 10

60: A STABILIZER THAT EXTRACTS LIGHT GAS OF A PRODUCT FROM THE HYDROFINING APPARATUS 30 FROM THE TOWER APEX

70: A NAPHTHA STORAGE TANK

80: A STORAGE TANK FOR A KEROSENE FRACTION THAT IS FRACTIONATED IN THE SECOND FRACTIONATOR 20 AS ONE OF SECOND MIDDLE FRACTIONS

90: A STORAGE TANK FOR A GAS OIL FRACTION THAT IS FRACTIONATED IN THE SECOND FRACTIONATOR 20 AS ANOTHER ONE OF SECOND MIDDLE FRACTIONS

90A: A DIESEL FUEL-STORAGE TANK.

BEST MODE FOR CARRYING OUT THE INVENTION

Hereinafter, the present invention will be described with regard to a preferred embodiment of a plant used for the method of manufacturing a diesel fuel according to the present invention with reference to FIG. 1.

The plant for manufacturing a diesel fuel shown in FIG. 1 includes a first fractionator 10 wherein FT synthetic oil is fractionated; and a hydro-refining apparatus 30, a hydroisomerizing apparatus 40 and a hydrocracking apparatus 50 which are apparatuses for treating a naphtha fraction, a middle oil fraction and a wax fraction fractionated in the first fractionator 10.

The naphtha fraction delivered from the hydrofining apparatus 30 passes through a stabilizer 60 and a line 61, and is stored in a naphtha storage tank 70 as naphtha.

The treated products from the hydroisomerizing apparatus 40 and the hydrocracking apparatus 50 are mixed, and then, the mixture is introduced into a second fractionator 20. The mixture may be fractionated into a kerosene fraction and a gas oil fraction in the second fractionator 20, and the kerosene fraction and the gas oil fraction are separately stored in a storage tank 80. However, the fractions are finally mixed and the mixture is stored in a tank for a diesel fuel-storage tank 90A. Moreover, the bottom fraction in the second fractionator 20 is delivered back to a line 14 prior to the hydrocracking apparatus 50 through a line 24, and the bottom fraction is recycled. Furthermore, a light tower apex fraction in the second fractionator 20 is delivered back to a line 31 prior to the stabilizer 60 through a line 21 and is introduced into the stabilizer 60.

In the first fractionator 10, the FT synthetic oil may be fractionated into three fractions of a naphtha fraction, a middle fraction and a wax fraction which may be separated by boiling points of, for example, 150° C. and 360° C. A line 1 for introducing the FT synthetic oil, and lines 12, 13 and 14 for delivering fractionated distillates (fractions) to the apparatuses are connected to the first fractionator 10. More specifically, the line 12 is a line that delivers a naphtha fraction fractionated under a condition of 150° C. or less; the line 13 is a line that delivers a middle fraction fractionated under a condition of 150° C. to 360° C.; and the line 14 is a line that delivers a wax fraction fractionated under a condition of more than 360° C. In addition, when the FT synthetic oil is fractionated, a cut point for each fraction is appropriately selected in terms of yield of the targeted final product, etc.

(Fractionation of FT Synthetic Oil)

FT synthetic oil applied to the present invention is not particularly limited as long as the FT synthetic oil is produced by the FT synthesis method. However, it is preferable that the synthetic oil contain 80% by mass or more of a hydrocarbon having a boiling point of 150° C. or higher, and 35% by mass or more of a hydrocarbon having a boiling point of 360° C. or higher, based on the total amount of the FT synthetic oil. The total amount of FT synthetic oil means the sum of hydrocarbons having 5 or more carbon atoms which are produced by the FT synthesis method.

In the first fractionator 10, at least two cut points may be set to fractionate the FT synthetic oil. Consequently, a fraction of less than the first cut point is obtained as a naphtha light fraction through the line 12; a fraction of the first cut point to the second cut point is obtained as a middle fraction corresponding to a gas oil fraction through the line 13; and a fraction of more than the second cut point is obtained as tower bottom oil (heavy wax component) corresponding to a wax fraction through the line 14.

Additionally, with regard to the pressure inside the first fractionator 10, distillation may be carried out under reduced pressure or normal pressure. However, distillation under normal pressure is general.

The naphtha fraction is sent to the hydro-refining apparatus 30 through the line 12, and the naphtha fraction is hydrogen-treated in the hydro-refining apparatus 30.

The middle fraction of the kerosene-gas oil fraction is sent to the hydroisomerizing apparatus 40 through the line 13, and the middle fraction is subjected to hydroisomerization in the hydroisomerizing apparatus 40.

The wax fraction is extracted through the line 14, and then is delivered to the hydrocracking apparatus 50 where the wax fraction is subjected to hydrocracking.

The naphtha fraction extracted through the line 12 is so-called naphtha, which may be used as a petrochemical raw material or a gasoline base stock.

Compared to naphtha produced from crude oil, the naphtha fraction obtained from the FT synthetic oil includes relatively large amounts of olefins and alcohols. Accordingly, it is difficult to use such naphtha fraction in the same manner as generally-called "naphtha". In addition, the lighter the fraction in the FT synthetic oil is, the higher content of olefins and alcohols the fraction has. Consequently, the content of olefins and alcohols in the naphtha fraction is the highest while the content in the wax fraction is the lowest among fractions.

Based on the above-described grounds, in the hydro-refining apparatus 30, olefins are hydrogenated by hydrogen treatment to convert the olefins into paraffins, and alcohols are subjected to hydrogen treatment to remove a hydroxyl group whereby the alcohols are also converted into paraffins. In addition, as long as the treated naphtha fraction is utilized for general naphtha use, it is unnecessary to conduct isomerization to convert n-paraffin into iso-paraffin, or decomposition of n-paraffins. That is, the naphtha fraction is delivered from the hydro-refining apparatus 30 to the stabilizer 60 through the line 31, light fractions such as gas are extracted from the top of the hydro-refining apparatus 30, and the naphtha fraction obtained from the bottom of the stabilizer 60 may be simply stored in the storage tank 70 through the line 61.

The kerosene-gas oil fraction, corresponding to the first middle fraction, which is extracted from the line 13 may be used, for example, as a diesel fuel base stock.

Since a substantial quantity of n-paraffins is contained in the first middle fraction obtained from the FT synthetic oil, low temperature properties (such as low-temperature flowability required for a diesel fuel base stock) of the first middle fraction may be insufficient. Therefore, the first middle fraction is hydroisomerized to improve the low temperature properties. If such hydroisomerization is performed, olefin hydrogenation and alcohol dehydroxylation can be simultaneously conducted in addition to isomerization. Since the middle fraction obtained by fractionating the FT synthetic oil may contain olefins or alcohols, hydroisomerization is preferably conducted. This is because olefins or alcohols can be converted into paraffins, and paraffins can be further converted into iso-paraffins.

In addition, hydrocracking may be simultaneously promoted depending on hydrogenation conditions. However, if hydrocracking is simultaneously promoted, the boiling point of the middle fraction will vary, or yield of the middle fraction will be lowered. Therefore, in the process of isomerizing the middle fraction, hydrocracking is preferably suppressed.

The wax fraction is extracted from the bottom line 14 of the first fractionator 10. The wax fraction obtained by fractionating the FT synthetic oil contains a substantial amount of heavy n-paraffins. Therefore, the wax fraction can be decomposed to increase the middle fraction, and the increased middle fraction is at least recovered.

The wax decomposition refers to hydrocracking. Such hydrocracking is preferable since the reaction converts olefins or alcohols, which may be included in the wax fraction, into paraffins.

Additionally, the product treated in the hydroisomerizing apparatus 40 passes through a line 41, and is introduced into the second fractionator 20.

In the same manner, the product treated in the hydrocracking apparatus 50 passes through a line 51, and is introduced into the second fractionator 20.

In the second fractionator, a hydroisomerized product and a hydrocracked product as treated products are mixed, and then, the mixture is fractionated. A light fraction is delivered to a naphtha fraction system through the line 21 while a kerosene fraction is extracted as one of the second middle fractions through the line 22 and is stored in the tank 80. In the same manner, a gas oil fraction is extracted as another one of the second middle fractions through the line 23 and is stored in the tank 90. Namely, the plurality of middle fractions is extracted.

The method of mixing the hydroisomerized product and the hydrocracked product is not particularly limited. For example, tank blending or line blending maybe adopted (not shown in figures).

A bottom fraction in the second fractionator 20 is recycled from the line 24 prior to the hydrocracking apparatus 50 for the wax fraction, and then is again hydrocracked in the hydrocracking apparatus 50 to increase the decomposition yield.

Plural types of diesel fuel base stocks is basically produced in the second fractionator 20, and obtained through, for example, the lines 22 and 23.

Thus, considering that the low temperature properties of the diesel fuel depends on the heavy portion, with regard to fractionation in the second fractionator, it is required to increase the degree of fractionation so that the n-paraffins corresponding to the heavy portion is drained from the bottom of the second fractionator. If more n-paraffins corresponding to the heavy portion are selectively drained from the bottom of the second fractionator 20, this contributes to an increase in decomposition yield due to recycling through the line 24. The degree of fractionation in the second fractionator may be improved according to any method known in the art. For example, increasing the number of rectification stages, selecting a tray enabling excellent rectification performance, or the like can be mentioned.

In addition, a pressure in the second fractionator may be a reduced pressure or, typically a normal pressure.

Additionally, with regard to the pressure inside the second fractionator, distillation may be carried out under reduced pressure or normal pressure. However, distillation under normal pressure is general.

With regard to the final diesel fuels, products are suitably extracted from the tanks 80 and 90, and are mixed. The mixture is stored in the diesel fuel tank 90A for use as a diesel fuel. A case wherein the kerosene fraction and the gas oil fraction are preferably stored in the tank 80 and the tank 90, respectively, and then, these are blended is described as a preferable embodiment. However, both fractions may be line-blended without using the tank 90A.

It is required for the diesel fuel to have kinematic viscosity at 30° C. of a certain value or higher (kinematic viscosity at 30° C. of 2.5 $mm^2$/sec or higher). to prevent occurrence of a broken oil film while operating a diesel engine. In addition, it is also required for the diesel fuel to have sufficient low temperature properties, for example, a lower PP (PP of −7.5° C. or less) when the diesel fuel material is utilized in cold regions.

Although the diesel fuel of the present invention requires kinematic viscosity at 30° C. of 2.5 $mm^2$/sec or higher, as described above, the upper limit of the kinematic viscosity is preferably 6.0 $mm^2$/sec. If the kinematic viscosity at 30° C. exceeds 6.0 $mm^2$/sec, it is not preferable since black smoke increases.

In addition, considering the use in cold regions, the PP needs to be −7.5° C. or less in order to attain sufficient low temperature properties. It is preferable that the pour point be as low as possible in terms of improvement in the low temperature performance of the diesel fuel. Therefore, the lower limit of the pour point is not particularly limited. However, if the pour point is excessively low, the above-mentioned the value of kinematic viscosity at 30° C. may be excessively small. Consequently, it may be difficult to achieve sufficient startability of the engine, stable engine rotation while idling, sufficient durability of a fuel injection pump, among others, under hot conditions. Therefore, it is preferable that the pour point be, for example, −25° C. or higher if the diesel fuel of the present invention is utilized under such high temperature. Furthermore, a diesel fuel whose pour point is adjusted within a range of −25° C. to −7.5° C. can achieve high performance even in a region with drastic changes in temperature. Therefore, such a diesel fuel is preferably used.

Accordingly, in the present invention, a step that allow both the kinematic viscosity and the PP of the manufactured diesel fuel to fall within the predetermined range is required, as described below in detail.

Such a kinematic viscosity of a certain value or higher, and a low PP are contrary to each other, and therefore, it is difficult to fulfill the both standard ranges thereof for a diesel fuel. For example, if the kinematic viscosity is to be increased, the PP also tends to be increased. Furthermore, it is difficult to predict both the kinematic viscosity and the PP from base stocks (i.e. kerosene fraction and gas oil fraction). Thus, a method of predicting the optimal blend ratio of the base stocks based on composition of the base stocks has been sought in order to produce a diesel fuel satisfying standard ranges of both the kinematic viscosity and the PP.

Specifically, in the conventional methods, there may be a situation where it is found out that the kinematic viscosity and/or the PP of the final diesel fuel deviate from the standard ranges only after the kinematic viscosity and the PP are measured with respect to the produced diesel fuel.

For example, If the diesel fuel is fractionated as a single second middle fraction in the second fractionator 20, the kinetic viscosity and the PP is supposed to be measured with respect to the obtained single fraction. Consequently, either the kinetic viscosity or the PP is likely to deviate from the standard range since these are physical properties which are incompatible with each other.

Therefore, as described above, the kerosene fraction and the gas oil fraction may be fractionated in the second fractionator 20. Then, the kerosene fraction is extracted from the line 22 as one of the second middle fractions while the gas oil fraction is extracted from the line 23 as another one of the second middle fractions. The kerosene fraction and the gas oil fraction are stored in the storage tanks 80 and 90. Subsequently, by controlling a blend ratio of the kerosene fraction and the gas oil fraction, a diesel fuel whose kinematic viscosity and PP fall within their respective standard ranges (kinematic viscosity at 30° C. of 2.5 $mm^2$/sec or higher and PP of −7.5° C. or less) can be easily obtained.

In addition, with regard to a cut point for the kerosene fraction and the gas oil fraction, for example, these fractions are preferably fractionated where the kerosene fraction contains 80% by volume or more of a component having a boiling point of 150° C. to 250° C. and where the gas oil fraction contains 80% by volume or more of a component having a boiling point of 250° C. to 360° C.

Furthermore, an appropriate blend ratio of the kerosene fraction and the gas oil fraction is obtained by predicting the kinematic viscosity at 30° C. and the PP of the diesel fuel based on an all component analysis by gas chromatography with respect to the kerosene fraction and the gas oil fraction in the second fractionator 20 and the blend ratio of both fractions. Then, both fractions from lines 81 and 91 are mixed at the appropriate blend ratio, and the mixture is stored in the diesel fuel tank 90A. Consequently, the actual viscosity and PP of the mixture precisely agree with the predicted values, and a diesel fuel whose kinematic viscosity and PP fall within standard ranges can be easily obtained. After all, the middle fraction are cut into the plurality of fractions having a narrower range of carbon numbers, which makes it easier to predict the above physical properties. Then, the composition of each fraction is analyzed, and the blend ratio is calculated based on predetermined equations, and the plurality of fractions is mixed at the obtained blend ratio.

Specifically, in the method of mixing the kerosene fraction and the gas oil fraction, an appropriate blend ratio of the kerosene fraction and the gas oil fraction is obtained based on the following Procedures (1) to (3) so that both the kinematic viscosity and the PP of the diesel fuel fall within predetermined ranges (kinematic viscosity at 30° C. of 2.5 $mm^2$/sec or higher and PP of −7.5° C. or less).

With regard to Procedure (1), the composition of the kerosene fraction and the composition of the gas oil fraction is analyzed based on an all component analysis by gas chromatography in advance, and, assuming that the fractions are mixed at a certain ratio, the composition of the produced diesel fuel is predicted. Next, in Procedure (2), based on the composition of the diesel fuel predicted in Procedure (1), the kinematic viscosity [Vis.] at 30° C. of the diesel fuel is calculated by Equation 1 and the PP of the diesel fuel is calculated by Equation 2, and then, the calculated values of physical properties of the diesel fuel are confirmed. In Procedure (3), an appropriate blend ratio of the kerosene fraction and the gas oil fraction where both the kinematic viscosity at 30° C. and the PP of the diesel fuel fall within the predetermined ranges is obtained.

More specifically, if the kinematic viscosity at 30° C. and the PP of the diesel fuel obtained in Procedure (2) fall within the predetermined ranges, it is determined that the blend ratio presumed in Procedure (1) is appropriate. If the presumed blend ratio is not within the predetermined ranges, then, a blend ratio of both fractions is again set, returning to Procedure (1), and the kinematic viscosity [Vis.] at 30° C. and the PP of the diesel fuel are calculated and confirmed in Procedure (2). Thus, Procedures (1) to (3) are repeated to obtain an appropriate blend ratio in Procedure (3).

$$[\text{Vis.}]=0.1309\times e(0.0144\times x^{[M.W.]}) \quad \text{[Equation 1]}$$

$$[\text{PP}]=46.37\times\log([nC19^{+}]+1.149)-45 \quad \text{[Equation 2]}$$

[Vis.]: Kinematic viscosity at 30° C. (calculated value)

[PP]: Pour point (calculated value)

$x^{[M.W.]}$: Average molecular weight of diesel fuel $[nC19^{+}]$: Content of normal paraffins having 19 or more carbon atoms in diesel fuel (% by mass)

As used herein, the kinematic viscosity at 30° C. refers to a value measured in accordance with JIS K2283 "Crude oil and petroleum products-Determination of kinematic viscosity and calculation of viscosity index from kinematic viscosity," and the PP refers to a value measured in accordance with JIS K2269 "Testing method for Pour Point and Cloud Point of Crude Oil and Petroleum Products."

The above Equations 1 and 2 are relations discovered by the present inventors through various studies on the all component analysis results of the kerosene fraction and the gas oil fraction obtained by treating the process of FT synthetic oil. Based on these equations, the presumed kinematic viscosity [Vis.] at 30 ° C. and the PP of the presumed diesel fuel can be highly accurately predicted.

In the above Equations, $x^{[M.W.]}$ refers to an average molecular weight calculated based on a component analysis result of components separated and quantitated by a gas chromatograph equipped with a nonpolar column, and a FID (flame ionization detector), and using He as a carrier gas and a predetermined temperature program. In the same manner, $[nC19^{+}]$ refers to the content (% by mass) of normal paraffins (n-paraffin) having 19 or more carbon atoms, which is a value (% by mass) obtained based on a component analysis result of components separated and quantitated by the gas chromatograph a nonpolar column, and a FID (flame ionization detector), and using He as a carrier gas and a predetermined temperature program.

Specifically, with regard to analysis results of the kerosene fraction and the gas oil fraction by the gas chromatograph under the above-mentioned conditions, the values obtained by multiplying the molecular weight of an n-paraffin or iso-paraffin of each carbon number and its content (% by mass) in the analysis results may be summed up to obtain the average molecular weight of each fraction. The calculated average molecular weight of each fraction may be further multiplied by its presumed blend ratio, and the obtained values of two fractions may be summed up to calculate the average molecular weight of the presumed diesel fuel (i.e. $x^{[M.W.]}$). On the other hand, the sum of contents (% by mass) of n-paraffins having 19 or more carbon atoms in each fraction is multiplied by the presumed blend ratio of each fraction, and the obtained values of both fractions may be summed up to obtain the value of $[nC19^{+}]$.

In addition, with regard to Procedures (1) to (3), the "composition of the kerosene fraction", "composition of the gas fraction" or "composition of the diesel fuel" in the present invention refers to information on the content of an n-paraffin or iso-paraffin in the fractions or the like, the average molecular weight of the fractions or the like, the content (% by mass) of an n-paraffin having 19 or more carbon atoms in the fraction or the like, among others, that can be obtained from the above-described component analysis results.

Next, the kerosene fraction and the gas oil fraction are extracted from the storage tanks 80 and 90, the fractions are mixed at the blend ratio obtained by the above-described procedures, and the mixture is stored in the diesel fuel tank 90A. Although the method of mixing the fractions is not shown in the figure, tank blending or line blending may be adopted. Thus, both the kinematic viscosity and the PP of the diesel fuel can fall within the predetermined ranges although a plurality of components are blended therein.

Hereinafter, conditions for operating each reaction apparatus will be described in more detail.

<Hydroisomerization of First Middle Fraction>

In the hydroisomerizing apparatus 40, the first middle fraction fractionated in the first fractionator is hydroisomerized. A known fixed-bed reactor may be used as the hydroisomerizing apparatus 40. In this embodiment of the present invention, the reactor, which is a fixed-bed flow reactor, is filled with a predetermined hydroisomerizing catalyst, and the first middle fraction obtained in the first fractionator 10 is hydroisomerized. As used herein, the hydroisomerization includes conversion of olefins into paraffins by hydrogen addition and conversion of alcohols into paraffins by dehydroxylation in addition to hydroisomerization of n-paraffins to iso-paraffin.

Examples of the hydroisomerizing catalyst include a carrier of a solid acid onto which an active metal belonging to Group VIII in the periodic table is loaded.

Preferable examples of such a carrier include a carrier containing one or more kinds of solid acids which are selected from amorphous metal oxides having heat resistance, such as silica alumina, silica zirconium oxide, or alumina-boria.

A mixture including the above-mentioned solid acid and a binder may be subjected to shaping, and the shaped mixture may be calcined to produce the catalyst carrier. The blend ratio of the solid acid therein is preferably within a range of 1% to 70% by mass, or more preferably within a range of 2% to 60% by mass with respect to the total amount of the carrier.

The binder is not particularly limited. However, the binder is preferably alumina, silica, silica alumina, titanic, or magnesia, and is more preferably alumina. The blend ratio of the binder is preferably within a range of 30% to 99% by mass, or more preferably within a range of 40% to 98% by mass based on the total amount of the carrier.

The calcination temperature of the mixture is preferably within a range of 400° C. to 550° C., more preferably within a range of 470° C. to 530° C., or particularly preferably within a range of 490° C. to 530° C.

Examples of the group VIII metal include cobalt, nickel, rhodium, palladium, iridium, platinum and the like. In particular, metal selected from nickel, palladium and platinum is preferably used singularly or in combination of two or more kinds.

These kinds of metal may be loaded on the above-mentioned carrier according to a common method such as impregnation, ion exchange or the like. The total amount of the loaded metal is not particularly limited. However, the amount of the loaded metal is preferably within a range of 0.1% to 3.0% by mass with respect to the carrier.

The hydroisomerization of the middle fraction may be performed under the following reaction conditions. The hydrogen partial pressure may be within a range of 0.5 MPa to 12 MPa, or preferably within a range of 1.0 MPa to 5.0 MPa. Liquid hourly space velocity (LHSV) of the middle fraction may be within a range of 0.1 $h^{-1}$ to 10.0 $h^{-1}$, or preferably within a range of 0.3 $h^{-1}$ to 3.5 $h^{-1}$. The hydrogen/oil ratio is not particularly limited. However, the hydrogen/oil ratio may be within a range of 50 NL/L to 1000 NL/L, or preferably within a range of 70 NL/L to 800 NL/L.

In the present description, "LHSV (liquid hourly space velocity)" refers to a volume flow rate of feedstock per capacity of a catalyst bed filled with catalyst under standard conditions (25° C. and 101,325 Pa), and the unit "$h^{-1}$" represents the reciprocal of hours. "NL" being the unit of hydrogen capacity in the hydrogen/oil ratio represents hydrogen capacity (L) under normal conditions (0° C. and 101,325 Pa).

The reaction temperature for the hydroisomerization may be within a range of 180° C. to 400° C., preferably within a range of 200° C. to 370° C., more preferably within a range of 250° C. to 350° C., or particularly within a range of 280° C. to 350° C. If the reaction temperature exceeds 400° C., a side reaction wherein the middle fraction is decomposed into a light fraction may be promoted, whereby yield of the middle fraction will be lowered, but also the product may be colored, and use of the middle fraction as a fuel base stock may be limited. Therefore, such a temperature range may not be preferred. On the other hand, if the reaction temperature is less than 180° C., alcohols may be insufficiently removed, and remain therein. Therefore, such a temperature range ma not be preferred.

<Hydrocracking of Wax Fraction>

In the hydrocracking apparatus 50, the wax fraction obtained from the first fractionator 10 is hydrogen-treated and decomposed. A known fixed-bed reactor may be used as the hydrocracking apparatus 50. In this embodiment of the present invention, the reactor, which is a fixed-bed flow reactor, is filled with a predetermined hydrocracking catalyst, and the wax fraction, which is obtained in the first fractionator 10 by way of fractionation, is hydrocracked therein. Preferably, a heavy fraction extracted from the bottom of the second fractionator 20 is delivered back to the line 14 through the line 24, and the heavy fraction is hydrocracked in the hydrocracking apparatus 50 along with the wax fraction from the first fractionator 10.

Although a chemical reaction that involves decrease in molecular weight mainly proceeds in the hydrogen treatment of the wax fraction, such hydrogen treatment includes hydroisomerization.

Examples of the hydrocracking catalyst include a carrier of a solid'acid onto which an active metal belonging to Group VIII in the periodic table is loaded.

Preferable examples of such a carrier include a carrier containing a crystalline zeolite such as ultra-stable Y type (USY) zeolite, HY zeolite, mordenite, or β-zeolite one; and at least one solid acid selected from amorphous metal oxides having heat resistance, such as silica alumina, silica zirconia or alumina boria. Moreover, it is preferable that the carrier is a carrier containing USY zeolite; and at least one solid acid selected from silica alumina, alumina boria, and silica zirconia. Furthermore, a carrier containing USY zeolite and silica alumina is more preferable.

USY zeolite is a Y-type zeolite that is ultra-stabilized by way of a hydrothermal treatment and/or acid treatment, and fine pores within a range of 20 Å to 100 Å are formed in addition to a micro porous structure, which is called micropores of 20 Å or less originally included in Y-type zeolite. When USY zeolite is used for the carrier of the hydrocracking catalyst, its average particle diameter is not particularly limited. However, the average particle diameter thereof is preferably 1.0 μm or less, or more preferably 0.5 μm or less. In USY zeolite, a molar ratio of silica/alumina (i.e. molar ratio of silica to alumina; hereinafter referred to as "silica/alumina ratio") is preferably within a range of 10 to 200, more preferably within a range of 15 to 100, and the most preferably within a range of 20 to 60.

It is preferable that the carrier include 0.1% to 80% by mass of a crystalline zeolite and 0.1% to 60% by mass of a heat-resistant amorphous metal oxide.

A mixture including the above-mentioned solid acid and a binder may be subjected to shaping, and the shaped mixture may be calcined to produce the catalyst carrier. The blend ratio of the solid acid therein is preferably within a range of 1% to 70% by mass, or more preferably within a range of 2% to 60% by mass with respect to the total amount of the carrier. If the carrier includes USY zeolite, the blend ratio of USY zeolite is preferably within a range of 0.1% to 10% by mass, or more preferably within a range of 0.5% to 5% by mass to the total amount of the carrier. If the carrier includes USY zeolite and alumina-boria, the blend ratio of USY zeolite to alumina-boria (USY zeolite/alumina-boria) is preferably within a range of 0.03 to 1 based on a mass ratio. If the carrier includes USY zeolite and silica alumina, the blend ratio of USY zeolite to silica alumina (USY zeolite/silica alumina) is preferably within a range of 0.03 to 1 based on a mass ratio.

The binder is not particularly limited. However, the binder is preferably alumina, silica, silica alumina, titania, or magnesia, and is more preferably alumina. The blend ratio of the binder is preferably within a range of 20% to 98% by mass, or more preferably within a range of 30% to 96% by mass based on the total amount of the carrier.

The calcination temperature of the mixture is preferably within a range of 400° C. to 550° C., more preferably within a range of 470° C. to 530° C., or particularly preferably within a range of 490° C. to 530° C.

Examples of the group VIII metal include cobalt, nickel, rhodium, palladium, iridium, platinum and the like. In particular, metal selected from nickel, palladium and platinum is preferably used singularly or in combination of two or more kinds.

These kinds of metal may be loaded on the above-mentioned carrier according to a common method such as impregnation, ion exchange or the like. The total amount of the loaded metal is not particularly limited. However, the amount of the loaded metal is preferably within a range of 0.1% to 3.0% by mass with respect to the carrier.

Hydrocracking the wax fraction may be performed under the following reaction conditions. That is, the hydrogen partial pressure may be within a range of 0.5 MPa to 12 MPa, or preferably within a range of 1.0 MPa to 5.0 MPa. Liquid hourly space velocity (LHSV) of the middle fraction may be within a range of 0.1 $h^{-1}$ to 10.0 $h^{-1}$, or preferably within a range of 0.3 $h^{-1}$ to 3.5 $h^{-1}$. The ratio is not particularly limited, but may be within a range of 50 NL/L to 1000 NL/L, preferably within a range of 70 NL/L to 800 NL/L.

The reaction temperature for hydrocracking may be within a range of 180° C. to 400° C., preferably within a range of 200° C. to 370° C., more preferably within a range of 250° C. to 350° C., particularly preferably 280° C. to 350° C. If the reaction temperature exceeds 400° C., a side reaction wherein the wax fraction is decomposed into a light fraction may be promoted, thereby decreasing yield of the wax fraction, and the product may be colored, thereby limiting use of the wax fraction as a fuel. Therefore, such a temperature range is not preferred. If the reaction temperature is less than 180° C., alcohols may be insufficiently removed, and may be remain therein. Therefore, such a temperature range is not preferred.

According to the method of the present invention, a diesel fuel preferably having a pour point of −7.5° C. or less and a kinematic viscosity at 30° C. of 2.5 $mm^2/s$ or higher may be produced.

EXAMPLES

Hereinafter, the present invention will be described in more detail with reference to Examples. However, the present invention is not limited to Examples.

<Preparation of Catalyst>

(Catalyst A)

Silica alumina (molar ratio of silica/alumina: 14), and an alumina binder were mixed and kneaded at a weight ratio of 60:40, and the mixture was shaped into a cylindrical form having a diameter of about 1.6 mm and a length of about 4 mm. Then, this was calcined at 500° C. for one hour, thereby producing a carrier. The carrier was impregnated with a chloroplatinic acid aqueous solution to distribute platinum on the carrier. The impregnated carrier was dried at 120° C. for 3 hours, and then, calcined at 500° C. for one hour, thereby producing catalyst A. The amount of platinum loaded on the carrier was 0.8% by mass to the total amount of the carrier.

(Catalyst B)

USY zeolite (molar ratio of silica/alumina: 37) having an average particle diameter of 1.1 silica alumina (molar ratio of silica/alumina: 14) and an alumina binder were mixed and kneaded at a weight ratio of 3:57:40, and the mixture was shaped into a cylindrical form having a diameter of about 1.6 mm and a length of about 4 mm. Then, this was calcined at 500° C. for one hour, thereby producing a carrier. The carrier was impregnated with a chloroplatinic acid aqueous solution to distribute platinum on the carrier. The impregnated carrier was dried at 120° C. for 3 hours, and then, calcined at 500° C. for one hour, thereby producing catalyst B. The amount of platinum loaded on the carrier was 0.8% by mass to the total amount of the carrier.

Example 1

<Manufacture of Diesel Fuel>

(Fractionation of FT Synthetic Oil)

In the first fractionator, oil produced by a FT synthesis method (i.e. FT synthetic oil) (the content of hydrocarbons having a boiling point of 150° C. or higher was 84% by mass, and the content of hydrocarbons having a boiling point of 360° C. or higher was 42% by mass, based on the total amount of the FT synthetic oil (corresponding to the sum of hydrocarbons having 5 or more carbon atoms)) was fractionated into a naphtha fraction having a boiling point of less than 150° C., a first middle fraction having a boiling point of 150° C. to 350° C. and a wax fraction as a bottom fraction.

(Hydroisomerization of First Middle Fraction)

The hydroisomerizing reactor 40, which is a fixed-bed flow reactor, was filled with the catalyst A (150 ml), the above-obtained middle fraction was supplied thereto from the tower apex of the hydroisomerizing reactor 40 at a rate of 225 ml/h, and the middle fraction was hydrogen-treated in a hydrogen stream under reaction conditions shown in Table 1.

That is, hydrogen was supplied from the tower apex at a hydrogen/oil ratio of 338 NL/L to the middle fraction, and the reactor pressure was adjusted with a back pressure valve, such that the inlet pressure remained constant at 3.0 MPa, and the hydroisomerization reaction was conducted. At that time, the reaction temperature was 308° C.

(Hydrocracking of Wax Fraction)

A reactor of the hydrocracking apparatus 50, which is a fixed-bed flow reactor, was filled with the catalyst A (150 ml), the above-obtained wax fraction was supplied thereto from the tower apex of the reactor at a rate of 300 ml/h. Then, the wax fraction was hydrocracked in a hydrogen stream under reaction conditions shown in Table 1.

That is, hydrogen was supplied thereto from the tower apex at a hydrogen/oil ratio of 667 NL/L for the wax fraction, and the reactor pressure was adjusted with a back pressure valve, such that the inlet pressure remained constant at 4.0 MPa, thereby hydrocracking the fraction. At that time, the reaction temperature was 329° C.

(Fractionation of Hydroisomerized Product and Hydrocracked Product)

The above-obtained hydroisomerized products of the middle fraction (isomerized middle fraction), and the above-obtained hydrocracked products of the wax fraction (wax-decomposition component) were line-blended at their respective yield coefficients, the obtained mixture was fractionated in a second fractionator 20. Consequently, a kerosene fraction (the boiling range was 150° C. to 250° C.) and a gas oil fraction (the boiling range was 250° C. to 350° C.) were extracted therefrom, and the fractions were stored in tanks and 80 and 90 via lines 22 and 23. Properties of the obtained kerosene fraction 1 and gas oil fraction 1 are shown in Table 2.

The contents (% by mass) of n-paraffins and iso-paraffins were obtained with respect to the carbon number, based on a component analysis results of the components separated and quantitated by a gas chromatograph (SHIMADZU Corporation gc-2010) equipped with a nonpolar column (ultraalloy-1HT (30 m×0.25 mm ϕ) and a FID (flame ionization detector), and using He as a carrier gas and a predetermined temperature program. The density at 15° C. was obtained in accordance with RS K2249 "Crude Oil And Petroleum Products—Density Test Method And Density·Mass·Volume Conversion Table", and the distillation properties were obtained in accordance with RS K2254 "Petroleum Products—Determination of distillation characteristics." Values were also calculated in Examples 2 to 4 and Comparative Examples 1 to 3 by the above-mentioned method unless otherwise mentioned below.

The bottom fraction in the second fractionator 20 is continuously delivered back to the line 14 that led to the hydrocracking apparatus 50 where hydrocracking is again performed.

A tower apex fraction in the second fractionator was extracted from the line 21, introduced into the extraction line 31 that extended from the hydro-refining apparatus 30, and the tower apex fraction was delivered to the stabilizer 60.

(Prediction of Kinematic Viscosity and PP)

Assuming that 10% by mass of the kerosene fraction 1 was blended with 90% by mass of the gas oil fraction 1 to produce a diesel fuel, an average molecular weight ($x^{[M.W.]}$) of the diesel fuel and the content ($nC19^+$) of n-paraffins having 19 or more carbon atoms in the diesel fuel were predicted based on the all component analysis. The predicted values are shown in Table 3. The kinematic viscosity at 30° C. and the PP of the diesel fuel are calculated by applying $x^{[M.W.]}$ and [$nC19^+$] to the above-mentioned Equations 1 and 2 and the calculated values are also shown in Table 3.

The kinematic viscosity at 30° C. (calculated value) and PP (calculated value) of the presumed diesel fuel satisfied their respective standards of 2.5 $mm^2/s$ or higher, and −7.5° C. or less. Based on the results, 10% by mass or more of the kerosene fraction 1 was blended with 90% by mass or more of the gas oil fraction 1 to produce a diesel fuel. The kinematic viscosity at 30° C. (measured value) and the PP (measured value) of the produced diesel fuel are also shown in Table 3. As a result, the measured values also satisfied the respective standard values of the kinematic viscosity at 30° C. and the PP. Thus, it was found that a desired diesel fuel can be manufactured by the manufacturing method of the present invention.

The density at 15° C. was obtained in accordance with MS K2249 "Crude Oil And Petroleum Products—Density Test Method And Density·Mass·Volume Conversion Table"; the kinematic viscosity at 30° C. (measured value) was obtained in accordance with HS K2283 "Crude Oil And petroleum products—Determination of kinematic viscosity and calculation of viscosity index from kinematic viscosity"; and the PP was obtained in accordance with HS K2269 "Testing method for Pour Point and Cloud Point of Crude Oil and Petroleum Products." In addition, the amounts of n-paraffins and iso-paraffins were obtained in accordance with the above-mentioned gas chromatographic analysis. Values were also obtained in Examples 2 to 4 and Comparative Examples 1 to 3 by the same method unless otherwise mentioned below.

Example 2

In this example, the fractionation of FT synthetic oil, the hydroisomerization of the first middle fraction, the hydrocracking of the wax fraction, and the fractionation of hydroisomerized products and hydrocracked products were performed in the same manner as in Example 1.

(Prediction of Kinematic Viscosity and Pour Point)

Assuming that 40% by mass of the kerosene fraction 1 was blended with 60% by mass of the gas oil fraction 1 to produce a diesel fuel, an average molecular weight ($x^{[M.W.]}$) of the diesel fuel and the content ($nC19^+$) of n-paraffins having 19 or more carbon atoms in the diesel fuel were predicted based on the all component analysis. The predicted values are shown in Table 3. The kinematic viscosity at 30° C. and the PP of the diesel fuel are calculated by applying $x^{[M.W.]}$ and [$nC19^+$] to the above-mentioned Equations 1 and 2 and the calculated values are also shown in Table 3.

The kinematic viscosity at 30° C. (calculated value) and PP (calculated value) of the presumed diesel fuel satisfied their respective standards of 2.5 $mm^2/s$ or higher, and −7.5° C. or less. Based on the results, 40% by mass or more of the kerosene fraction 1 was blended with 60% by mass or more of the gas oil fraction to produce a diesel fuel. The kinematic viscosity at 30° C. (measured value) and the PP (measured value) of the produced diesel fuel are also shown in Table 3. As a result, the measured values also satisfied the respective standard values of the kinematic viscosity at 30° C. and the PP. Thus, it was found that a desired diesel fuel can be manufactured by the manufacturing method of the present invention.

Example 3

(Fractionation of FT Synthetic Oil)

In the first fractionator, oil produced by a FT synthesis method (i.e. FT synthetic oil) (the content of hydrocarbons having a boiling point of 150° C. or higher was 84% by mass, and the content of hydrocarbons having a boiling point of 360° C. or higher was 42% by mass, based on the total amount of the FT synthetic oil (corresponding to the sum of hydrocarbons having 5 or more carbon atoms)) was fractionated into a naphtha fraction having a boiling point of less than 150° C., a first middle fraction having a boiling point of 150° C. to 350° C. and a wax fraction as a bottom fraction.

(Hydroisomerization of First Middle Fraction)

The fixed-bed flow reactor was filled with the catalyst A (150 ml), the above-obtained middle fraction was supplied thereto from the tower apex of the hydroisomerizing reactor 40 at a rate of 225 ml/h, and the middle fraction was hydrogen-treated in a hydrogen stream under reaction conditions shown in Table 1.

That is, hydrogen was supplied from the tower apex at a hydrogen/oil ratio of 338 NL/L to the middle fraction, and the reactor pressure was adjusted with a back pressure valve, such that the inlet pressure remained constant at 3.0 MPa, and the hydroisomerization reaction was conducted. At that time, the reaction temperature was 308° C.

(Hydrocracking of Wax Fraction)

The reactor of the hydrocracking apparatus 50, which is a fixed-bed flow reactor, was filled with the catalyst A (150 ml), the above-obtained wax fraction was supplied thereto from the tower apex of the reactor at a rate of 300 ml/h. Then, the wax fraction was hydrocracked in a hydrogen stream under reaction conditions shown in Table 1.

That is, hydrogen was supplied thereto from the tower apex at a hydrogen/oil ratio of 667 NL/L for the wax fraction, and the reactor pressure was adjusted with a back pressure valve, such that the inlet pressure remained constant at 4.0 MPa, thereby hydrocracking the fraction. At that time, the reaction temperature was 327° C.

(Fractionation of Hydroisomerized Product and Hydrocracked Product)

The above-obtained hydroisomerized products of the middle fraction (isomerized middle fraction), and the above-obtained hydrocracked products of the wax fraction (wax-decomposition component) were line-blended at their respective yield coefficients, the obtained mixture was fractionated in a second fractionator 20. Consequently, a kerosene fraction (the boiling range was 150° C. to 250° C.) and a gas oil fraction (the boiling range was 250° C. to 350° C.) were extracted therefrom, and the fractions were stored in tanks and 80 and 90. Properties of the obtained kerosene fraction 2 and gas oil fraction 2 are shown in Table 2.

The bottom fraction in the second fractionator 20 is continuously delivered back to the line 14 that led to the hydrocracking apparatus 50 where hydrocracking is again performed.

A tower apex fraction in the second fractionator was extracted from the line 21, introduced into the extraction line 31 that extended from the hydro-refining apparatus 30, and the tower apex fraction was delivered to the stabilizer 60.

(Prediction of Kinematic Viscosity and PP)

Assuming that 40% by mass of the kerosene fraction 2 was blended with 60% by mass of the gas oil fraction 2 to produce a diesel fuel, an average molecular weight ($x^{[M.W.]}$) of the diesel fuel and the content ($nC19^+$) of n-paraffins having 19 or more carbon atoms in the diesel fuel were predicted based on the all component analysis. The predicted values are shown in Table 3. The kinematic viscosity at 30° C. and the PP of the diesel fuel are calculated by applying $x^{[M.W.]}$ and [$nC19^+$] to the above-mentioned Equations 1 and 2 and the calculated values are also shown in Table 3.

The kinematic viscosity at 30° C. (calculated value) and PP (calculated value) of the presumed diesel fuel satisfied their respective standards of 2.5 $mm^2/s$ or higher, and −7.5° C. or less. Based on the results, 40% by mass or more of the kerosene fraction 2 was blended with 60% by mass or more of the gas oil fraction 2 to produce a diesel fuel. The kinematic viscosity at 30° C. (measured value) and the PP (measured value) of the produced diesel fuel are also shown in Table 3. As a result, the measured values also satisfied the respective standard values of the kinematic viscosity at 30° C. and the PP. Thus, it was found that a desired diesel fuel can be manufactured by the manufacturing method of the present invention.

Example 4

In this example, the fractionation of FT synthetic oil, the hydroisomerization of the first middle fraction, the hydrocracking of the wax fraction, and the fractionation of hydroisomerized products and hydrocracked products were performed in the same manner as Example 3.

(Prediction of Kinematic Viscosity and Pour Point)

Assuming that 50% by mass of the kerosene fraction 2 was blended with 50% by mass of the gas oil fraction 2 to produce a diesel fuel, an average molecular weight ($x^{[M.W.]}$) of the diesel fuel and the content ($nC19^+$) of n-paraffins having 19 or more carbon atoms in the diesel fuel were predicted based on the all component analysis. The predicted values are shown in Table 3. The kinematic viscosity at 30° C. and the PP of the diesel fuel are calculated by applying $x^{[M.W.]}$ and [$nC19^+$] to the above-mentioned Equations 1 and 2 and the calculated values are also shown in Table 3.

The kinematic viscosity at 30° C. (calculated value) and PP (calculated value) of the presumed diesel fuel satisfied their respective standards of 2.5 $mm^2/s$ or higher, and −7.5° C. or less. Based on the results, 50% by mass or more of the kerosene fraction 2 was blended with 50% by mass or more of the gas oil fraction 2 to produce a diesel fuel. The kinematic viscosity at 30° C. (measured value) and the PP (measured value) of the produced diesel fuel are also shown in Table 3. As a result, the measured values also satisfied the respective standard values of the kinematic viscosity at 30° C. and the PP. Thus, it was found that a desired diesel fuel can be manufactured by the manufacturing method of the present invention.

Comparative Example 1

In this comparative example, the fractionation of FT synthetic oil, the hydroisomerization of the first middle fraction, and the hydrocracking of the wax fraction were performed in the same manner as Example 1.

(Fractionation of Hydroisomerized Products and Hydrocracked Products)

The above-obtained hydroisomerized products of middle fraction (isomerized middle fraction) and the above-obtained hydrocracked products of the wax fraction (hydrocracked wax fraction) were line-blended at their respective yield coefficients. The obtained mixture was fractionated in the second fractionator 20, and a fraction of a boiling range of 150 to 350° C. was extracted, and stored as a diesel fuel in the tank 90A.

The bottom fraction in the second fractionator 20 was continuously delivered back to the entrance line 14 of the hydrocracking apparatus 50 where hydrocracking was again performed.

A tower apex fraction in the second fractionator was extracted from the line 21, introduced into the extraction line 31 that extended from the hydrofining apparatus 30, and delivered to the stabilizer 60.

Table 3 shows properties of the obtained diesel fuel. The kinematic viscosity of the obtained diesel fuel deviates from its standard range. Therefore, it was evident that the manufacturing method required complicated procedures where a cut point in the second fractionator needed to be adjusted by trial and error in order to obtain a desirable diesel fuel.

Comparative Example 2

In this comparative example, the fractionation of FT synthetic oil, the hydroisomerization of the first middle fraction, the hydrocracking of the wax fraction, and the fractionation of hydroisomerized products and hydrocracked products were performed in the same manner as Example 1.

(Prediction of Kinematic Viscosity and Pour Point)

Assuming that 50% by mass of the kerosene fraction 1 was blended with 50% by mass of the gas oil fraction 1 to produce a diesel fuel, an average molecular weight ($x^{[M.W.]}$) of the diesel fuel and the content ($nC19^+$) of n-paraffins having 19 or more carbon atoms in the diesel fuel were predicted. The predicted values are shown in Table 3. The kinematic viscosity at 30° C. and the PP of the diesel fuel are calculated by applying $x^{[M.W.]}$ and [$nC19^+$] to the above-mentioned Equations 1 and 2 and the calculated values are also shown in Table 3.

With regard to the kinematic viscosity at 30° C. (calculated value) and PP (calculated value) of the presumed diesel fuel, the PP standard (−7.5° C. or less) was satisfied. However, the standard for the kinematic viscosity at 30° C. (2.5 $mm^2/s$ or higher) was not satisfied. 50% by mass or more of the kerosene fraction 2 was blended with 50% by mass or more of the gas oil fraction 2 to produce an actual diesel fuel. The kinematic viscosity at 30° C. (measured value) and the PP (measured value) of the produced diesel fuel are also shown in Table 3. As a result, the measured value of the kinematic viscosity at 30° C. also deviated from the standard range.

Comparative Example 3

In this comparative example, the fractionation of FT synthetic oil, the hydroisomerization of the first middle fraction, the hydrocracking of wax fraction, and the fractionation of hydroisomerized products and hydrocracked products were performed in the same manner as Example 3.

(Prediction of Kinematic Viscosity and Pour Point)

Assuming that 30% by mass of the kerosene fraction 2 was blended with 70% by mass of the gas oil fraction 2 to produce a diesel fuel, an average molecular weight ($x^{[M.W.]}$) of the diesel fuel and the content ($nC19^{+}$) of n-paraffins having 19 or more carbon atoms in the diesel fuel were predicted based on the all component analysis. The predicted values are shown in Table 3. The kinematic viscosity at 30° C. and the PP of the diesel fuel are calculated by applying $x^{[M.W.]}$ and [$nC19^{+}$] to the above-mentioned Equations 1 and 2 and the calculated values are also shown in Table 3.

With regard to the kinematic viscosity at 30° C. (calculated value) and PP (calculated value) of the presumed diesel fuel, the PP standard (−7.5° C. or less) was satisfied. However, the standard for the kinematic viscosity at 30° C. (2.5 $mm^2/s$ or higher) was not satisfied. 30% by mass or more of the kerosene fraction 2 was blended with 70% by mass or more of the gas oil fraction 2 to produce an actual diesel fuel. The kinematic viscosity at 30° C. (measured value) and the PP (measured value) of the produced diesel fuel are also shown in Table 3. As a result, the measured value of the kinematic viscosity at 30° C. also deviated from the standard range.

TABLE 1

| | | Condition of Example 1 | Condition of Example 3 |
|---|---|---|---|
| Conditions of hydroisomerization of first middle fraction | Catalyst | Catalyst A | Catalyst A |
| | LHSV ($h^{-1}$) | 1.5 | 1.5 |
| | Reaction temperature (° C.) | 308 | 308 |
| | Hydrogen partial pressure (MPa) | 3.0 | 3.0 |
| | Hydrogen/oil ratio (NL/L) | 338 | 338 |
| Conditions of hydrocracking of wax fraction | Catalyst | Catalyst B | Catalyst B |
| | LHSV ($h^{-1}$) | 2.0 | 2.0 |
| | Reaction temperature (° C.) | 329 | 327 |
| | Hydrogen partial pressure (MPa) | 4.0 | 4.0 |
| | Hydrogen/oil ratio (NL/L) | 667 | 667 |

TABLE 2

| | | Kerosene fraction 1 | Kerosene fraction 2 | Gas oil fraction 1 | Gas oil fraction 2 |
|---|---|---|---|---|---|
| Density@ 15° C. ($g/cm^3$) | | 0.7481 | 0.7494 | 0.7792 | 0.7810 |
| Distillation properties | T10 (° C.) | 149.5 | 151.0 | 251.0 | 260.0 |
| | T90 (° C.) | 250.5 | 261.0 | 350.0 | 362.0 |
| | Fraction having boiling point of 150° C. to 250° C. (vol %) | 90.0 | 85.0 | 10.0 | 5.0 |
| | Fraction having boiling point of 250° C. to 360° C. (vol %) | 10.0 | 15.0 | 90.0 | 95.0 |
| Amount of n-paraffin (% by mass) | | 44.8 | 44.9 | 22.8 | 23.8 |
| C7 | (% by mass) | 0.0 | 0.0 | — | — |
| C8 | (% by mass) | 0.2 | 0.1 | — | — |
| C9 | (% by mass) | 5.3 | 3.5 | — | — |
| C10 | (% by mass) | 11.6 | 11.3 | 0.1 | 0.0 |
| C11 | (% by mass) | 10.5 | 10.3 | 0.2 | 0.1 |
| C12 | (% by mass) | 8.8 | 8.9 | 0.6 | 0.4 |
| C13 | (% by mass) | 6.2 | 6.5 | 1.3 | 0.8 |
| C14 | (% by mass) | 2.2 | 3.9 | 4.0 | 1.8 |
| C15 | (% by mass) | 0.0 | 0.4 | 4.7 | 4.3 |
| C16 | (% by mass) | — | — | 3.2 | 3.3 |
| C17 | (% by mass) | — | — | 2.3 | 2.4 |
| C18 | (% by mass) | — | — | 1.8 | 1.9 |
| C19 | (% by mass) | — | — | 1.3 | 1.5 |
| C20 | (% by mass) | — | — | 1.2 | 1.4 |
| C21 | (% by mass) | — | — | 1.0 | 1.4 |
| C22 | (% by mass) | — | — | 0.7 | 1.3 |
| C23 | (% by mass) | — | — | 0.4 | 1.1 |
| C24 | (% by mass) | — | — | 0.1 | 0.9 |
| C25 | (% by mass) | — | — | 0.0 | 0.6 |
| C26 | (% by mass) | — | — | 0.0 | 0.6 |
| Amount of iso-paraffin (% by mass) | | 55.2 | 55.1 | 77.2 | 76.2 |
| C7 | (% by mass) | 0.0 | 0.0 | — | — |
| C8 | (% by mass) | 0.2 | 0.1 | — | — |
| C9 | (% by mass) | 4.2 | 1.6 | — | — |
| C10 | (% by mass) | 9.6 | 8.7 | 0.0 | 0.0 |
| C11 | (% by mass) | 11.5 | 10.6 | 0.2 | 0.1 |
| C12 | (% by mass) | 11.8 | 11.2 | 0.7 | 0.4 |
| C13 | (% by mass) | 11.6 | 11.5 | 2.1 | 1.3 |
| C14 | (% by mass) | 6.2 | 9.5 | 8.6 | 3.8 |
| C15 | (% by mass) | 0.2 | 1.8 | 15.2 | 12.8 |
| C16 | (% by mass) | — | — | 14.3 | 14.0 |
| C17 | (% by mass) | — | — | 11.4 | 11.4 |
| C18 | (% by mass) | — | — | 8.6 | 8.8 |
| C19 | (% by mass) | — | — | 6.1 | 6.4 |
| C20 | (% by mass) | — | — | 4.0 | 4.5 |
| C21 | (% by mass) | — | — | 2.9 | 3.6 |
| C22 | (% by mass) | — | — | 1.9 | 2.9 |
| C23 | (% by mass) | — | — | 0.8 | 2.3 |
| C24 | (% by mass) | — | — | 0.3 | 1.7 |

TABLE 2-continued

| | Kerosene fraction 1 | Kerosene fraction 2 | Gas oil fraction 1 | Gas oil fraction 2 |
|---|---|---|---|---|
| C25 (% by mass) | — | — | 0.1 | 1.2 |
| C26 (% by mass) | — | — | 0.0 | 0.9 |

TABLE 3

| | | | Example 1 | Example 2 | Example 3 | Example 4 | Comparative Example 1 | Comparative Example 2 | Comparative Example 3 |
|---|---|---|---|---|---|---|---|---|---|
| Base stock | | | Kerosene fraction 1 Gas oil fraction 1 | Kerosene fraction 1 Gas oil fraction 1 | Kerosene fraction 2 Gas oil fraction 2 | Kerosene fraction 2 Gas oil fraction 2 | Diesel fuel — | Kerosene fraction 1 Gas oil fraction 1 | Kerosene fraction 2 Gas oil fraction 2 |
| Prediction | Blend ratio (assumed) | Kerosene fraction (% by mass) | 10 | 40 | 40 | 50 | — | 50 | 30 |
| | | Gas oil fraction (% by mass) | 90 | 60 | 60 | 50 | — | 50 | 70 |
| | Average molecular weight (MW) | | 227 | 205 | 216 | 208 | — | 198 | 225 |
| | n-paraffin having C19 or higher (% by mass) | | 4.3 | 2.9 | 5.3 | 4.4 | — | 2.4 | 6.2 |
| | Kinematic viscosity@ 30° C. (calculated value)*1 ($mm^2/s$) | | 3.4 | 2.5 | 2.9 | 2.6 | — | 2.3 | 3.3 |
| | Pour point (calculated value)*2 (° C.) | | −10.9 | −16.8 | −7.5 | −10.5 | — | −19.5 | −4.8 |
| Measurement | Blend ratio | Kerosene fraction (% by mass) | 10 | 40 | 40 | 50 | — | 50 | 30 |
| | | Gas oil fraction (% by mass) | 90 | 60 | 60 | 50 | — | 50 | 70 |
| | Density@ 15° C. ($g/cm^3$) | | 0.7761 | 0.7668 | 0.7684 | 0.7652 | 0.7626 | 0.7637 | 0.7720 |
| | n-paraffim amount (% by mass) | | 25.0 | 31.6 | 32.2 | 34.4 | 34.5 | 33.8 | 30.1 |
| | iso-paraffin amount (% by mass) | | 75.0 | 68.4 | 67.8 | 65.7 | 65.5 | 66.2 | 69.9 |
| | Kinematic viscosity@ 30° C. (measured value) ($mm^2/s$) | | 3.5 | 2.5 | 3.1 | 2.6 | 2.2 | 2.3 | 3.3 |
| | Pour point (measured value) (° C.) | | −10.0 | −17.5 | −7.5 | −10.0 | −20.0 | −20.0 | −5.0 |

*1 $[Vis.] = 0.1309 \times e(0.0144 \times x^{[M.W.]})$

*2 $[PP] = 46.37 \times \log([nC19^{+}] + 1.149) - 45$

As demonstrated above, according to the manufacturing method of the present invention, a diesel fuel whose PP and kinematic viscosity at 30° C., which are incompatible with each other, simultaneously fall within their respective standard values can be manufactured.

Industrial Applicability

According to the present invention, a diesel fuel having excellent low temperature properties can be produced from FT synthetic oil. Therefore, the diesel fuel manufactured by the method of the present invention can be utilized under low temperature environments while diesel fuels produced by the prior arts cannot be utilized under such environments. Accordingly, the present invention has high applicability in industries including GTL (Gas to Liquid) and petroleum refinement.

The invention claimed is:

1. A method for producing diesel fuel, comprising:

fractionating a synthetic oil obtained by Fisher-Tropsch synthesis into a plurality of fractions including a middle fraction, and a wax fraction in a first fractionator, wherein the wax fraction contains a wax component heavier than the middle fraction;

hydroisomerizing the middle fraction with a hydroisomerizing catalyst, thereby producing a hydroisomerized middle fraction;

hydrocracking the wax fraction with a hydrocracking catalyst, thereby producing a hydrocracked wax decomposition compound;

separating a mixture of the hydroisomerized middle fraction and the hydrocracked wax decomposition compound into a plurality of fractions including a kerosene fraction and a gas oil fraction by fractionation in a second fractionator;

analyzing the composition of each of the plurality of fractions including the kerosene fraction and the gas oil fraction;

predicting one or more properties of a diesel fuel formed from the fractions based on the composition of each of the fractions;

determining a mixing ratio of the fractions so as to have the values of the properties within respective predetermined ranges; and mixing the fractions including the kerosene fraction and the gas oil fraction at the mixing ratio, thereby producing the diesel fuel.

2. The method for producing diesel fuel according to claim 1, wherein the kerosene fraction contains 80% by volume or more of a component having a boiling point of 150° C. to 250° C., and the gas oil fraction contains 80% by volume or more of a component having a boiling point of 250° C. to 360° C.

3. The method for producing diesel fuel according to claim 1, wherein, when bringing the middle fraction into contact with the hydroisomerizing catalyst, the reaction temperature is 180° C. to 400° C., the hydrogen partial pressure is 0.5 MPa to 12 MPa, and the liquid hourly space velocity is $0.1\ h^{-1}$ to $10.0\ h^{-1}$, and when bringing the wax fraction into contact with the hydrocracking catalyst, the reaction temperature is 180° C. to 400° C., the hydrogen partial pressure is 0.5 MPa to 12 MPa, and the liquid hourly space velocity is 0.1 $h^{-1}$ to 10.0 $h^{-1}$.

4. The method for producing diesel fuel according to claim 1, wherein the one or more properties are kinematic viscosity at 30° C. and pour point of a diesel fuel.

5. A method for producing diesel fuel, comprising:

fractionating a synthetic oil obtained by Fisher-Tropsch synthesis into a plurality of fractions including a middle fraction, and a wax fraction in a first fractionator, wherein the wax fraction contains a wax component heavier than the middle fraction;

hydroisomerizing the middle fraction with a hydroisomerizing catalyst, thereby producing a hydroisomerized middle fraction;

hydrocracking the wax fraction with a hydrocracking catalyst, thereby producing a hydrocracked wax decomposition compound;

separating a mixture of the hydroisomerized middle fraction and the hydrocracked wax decomposition compound into a plurality of fractions including a kerosene fraction and a gas oil fraction by fractionation in a second fractionator; and mixing the fractions including the kerosene fraction and the gas oil fraction, thereby producing the diesel fuel, wherein, an appropriate mixing ratio of the kerosene fraction and the gas oil fraction is obtained by the following steps (1) to (3):

(1) analyzing the composition of the kerosene fraction and the composition of the gas oil fraction based on an all-component analysis by gas chromatography in advance, and predicting the composition of the produced diesel fuel with respect to $x^{[M.W.]}$ and $[nC19^{+}]$ when assuming that the kerosene fraction and the gas oil fraction are mixed at a specific ratio;

(2) calculating the kinematic viscosity [Vis.] at 30° C. of the diesel fuel by Equation 1 and calculating the pour point of the diesel fuel by Equation 2 based on the composition of the produced diesel fuel predicted in step (1); and (3) when the kinematic viscosity at 30° C. of the diesel fuel calculated in step (2) is 2.5 $mm^2/s$ or more and the pour point of the diesel fuel calculated in step (2) is −7.5° C. or less, completing the steps by determining that the specific ratio of the kerosene fraction and the gas oil fraction assumed in step (1) is the appropriate mixing ratio of the kerosene fraction and the gas oil fraction, and when the kinematic viscosity at 30° C. of the diesel fuel calculated in step (2) is less than 2.5 $mm^2/s$ and the pour point of the diesel fuel calculated in step (2) is more than −7.5° C., repeating the steps (1) to (3) until the appropriate mixing ratio of the kerosene fraction and the gas oil fraction where the kinematic viscosity of the diesel fuel at 30° C. is 2.5 $mm^2/s$ or more and the pour point of the diesel fuel is −7.5° C. or less is obtained, where $$[\text{Vis.}]=0.1309\times e(0.0144\times x^{[M.W.]}) \quad \text{Equation 1,}$$

and $$[\text{PP}]=46.37\times\log([nC19^{+}]+1.149)-45 \quad \text{Equation 2}$$

wherein, [Vis.] represents the kinematic viscosity at 30° C.; [PP] represents the pour point;

$x^{[M.W.]}$ represents the average molecular weight of the diesel fuel; and $[nC19^{30}]$ represents the content of normal paraffins having 19 or more carbon atoms in the diesel fuel by mass percentage.

* * * * *

UNITED STATES PATENT AND TRADEMARK OFFICE

CERTIFICATE OF CORRECTION

PATENT NO. : 8,734,636 B2
APPLICATION NO. : 12/733860
DATED : May 27, 2014
INVENTOR(S) : Yuichi Tanaka It is certified that error appears in the above-identified patent and that said Letters Patent is hereby corrected as shown below:

In the Specification

Column 11, line 61, change "a temperature range ma" to -- a temperature range may --;

Column 12, line 15, change "a solid' acid" to -- a solid acid --;

Column 15, line 3, change "RS K2249" to -- JIS K2249 --;

Column 15, line 6, change "RS K2254" to -- JIS K2254 --;

Column 15, line 43, change "MS" to -- JIS --;

Column 15, line 47, change "HS K2283" to -- JIS K2283 --;

Column 15, line 50, change "HS K2269" to -- JIS K2269 --;

In the Claims

Column 24, line 33, change "[$nC19^{30}$]" to -- [$nC19^{+}$] --.

Signed and Sealed this
Eleventh Day of November, 2014

Michelle K. Lee

Michelle K. Lee
*Deputy Director of the United States Patent and Trademark Office*